United States Patent [19]

Sampsell

[11] 4,146,406

[45] Mar. 27, 1979

[54] BARGE TANK BOTTOM CLEANER

[75] Inventor: David F. Sampsell, Wheaton, Ill.

[73] Assignee: Ingram Industries, Inc., Nashville, Tenn.

[21] Appl. No.: 844,522

[22] Filed: Oct. 25, 1977

[51] Int. Cl.[2] ..... B08B 3/02; B08B 9/08

[52] U.S. Cl. ..... 134/167 R; 134/179; 239/227; 239/229

[58] Field of Search ..... 134/167 R, 168 R, 179; 239/227, 229, 255

[56] References Cited

U.S. PATENT DOCUMENTS

| | | | |
|---|---|---|---|
| 1,545,896 | 7/1925 | Hanlon | 134/167 R |
| 2,975,791 | 3/1961 | Pansini | 134/167 R |
| 3,032,044 | 5/1962 | Pansini | 134/168 R X |
| 3,117,584 | 1/1964 | Elenbaas | 134/168 R |
| 3,289,238 | 12/1966 | Sorenson et al. | 134/179 X |
| 4,030,513 | 6/1977 | McKenzie | 134/167 R |

FOREIGN PATENT DOCUMENTS

| | | | |
|---|---|---|---|
| 521181 | 12/1976 | U.S.S.R. | 134/167 R |

*Primary Examiner*—Robert L. Bleutge
*Attorney, Agent, or Firm*—Watson D. Harbaugh

[57] ABSTRACT

The bottoms of transport barge tanks when emptied of high consistency treated sludge are automatically and quickly hosed clean of heavy sediment, as much as a foot deep without labor and with an economical use of a reversely directed progressively self-rotated stream of water that is easily serviced.

6 Claims, 3 Drawing Figures

BARGE TANK BOTTOM CLEANER

BACKGROUND OF THE INVENTION

A serious problem confronting tank barge operators transporting digested sewage sludge, is the removal of residue comprising sludge solids which settle out of suspension during transit. This residue, which is normally too thick to flow quickly, can reduce barge capacity substantially. In order to remove this residue, it is necessary to forcefully dilute the solids with a water jet which has the effect of breaking up and flowing agglomerated heavy residue material.

Manning a high pressure water hose to remove the residue is costly and hazardous to labor, and while tank cleaning machines heretofore available have been tried, their slow progression to all tank surfaces involved has not been conducive to agitating the residue body. Furthermore, substantial time and wash water is wasted cleaning the tank top and sides where residue is not an initiating problem.

The residue, which is normally too thick to flow readily, can reduce barge capacity substantially and can accummulate and require major labor clean up efforts if not quickly removed each trip. Sending a man into a barge tank with a high-pressure water hose just to clean up residue at any time is costly and unduly hazardous, under most conditions, just to maintain economical cargo capacity.

DESCRIPTION OF THE PRIOR ART

Tank cleaning machines heretofore available have been used with limited results. Conventional machines generally involve a means or mechanism which directs water jets in a slow progression to all tank surfaces. Slow movement of the jets is not conducive to agitating the heavy residue. Moreover, a substantial amount of time and wash water is wasted needlessly cleaning the tank top and sides as well as the bottom.

Most water jet cleaning machines are concerned with swimming pools with water in them. Some employ a submerged whipping hose to return minute solids to suspension in the main body of water. Others withdraw pool water and dirt from next to the walls to wash them. The hose action is not critical since it sets a large portion of stagnent water in moderate motion. However, when empty, the pool walls and bottom are then manually brush scrubbed and rinsed by hand held hose, thereby indirectly indicating the unsuccessful or limited use of a submerged hose in washing mud from the walls and bottom of an emptied pool.

SUMMARY OF THE INVENTION

In the present invention the preferred embodiment employs a vertical water pressure supply pipe extending normal to the tank bottom and downwardly through a removable hatch to a point spaced an appreciable distance from the bottom where a frictional rotatable swivel joint is mounted vertically and receives on its lower end an elbow carrying a horizontally disposed extension of pipe capable of continuous rotation free from any interference with any support or frame structure in the tank that generally surrounds a hatch at the center of the tank.

The free end of the horizontal pipe preferably carries a U-shaped assembly defining a vertically disposed frictionally adjustable joint providing relative movement about a vertical axis between the pipe and its lower elbow which carries a second horizontal pipe terminally supporting an open ended flexible hose which under flow of water therethrough whips the end of the hose in a vertical quadrant essentially below horizontal and being adjustable to provide, in plan, an acute angle between the horizontal pipes at the joint.

Water ejected from the hose not only provides a whipping action essentially vertical but provides a moment of force that turns the upper swivel joint to permit the hose water jet to cover 360° with its end comparatively close to the axis of the upper swivel joint yet with enough hose length to whip freely in an essentially vertical relation, which and also provides a moment of force and direction which bodily rotates the vertical pipe assembly below the upper swivel.

The swivel joint may be located above the hatch if so desired whereby the rotation of the hose may be positively driven or viewed. Preferably however, the speed of rotation and direction is provided automatically by the plan angle between the horizontal pipes at the lower swivel even though it might only be frictionally held or controlled.

IN THE DRAWINGS

DESCRIPTION OF THE PREFERRED EMBODIMENTS

Figure 1:
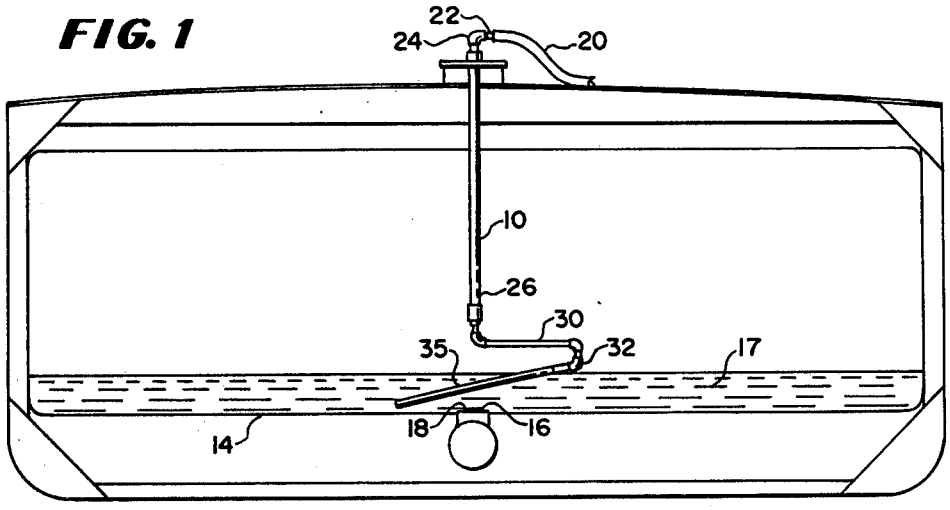
FIG. 1 is a diagrammatical cross-sectional view of a barge tank with residue in it and equipped with a preferred embodiment of the invention.
Figure 2:
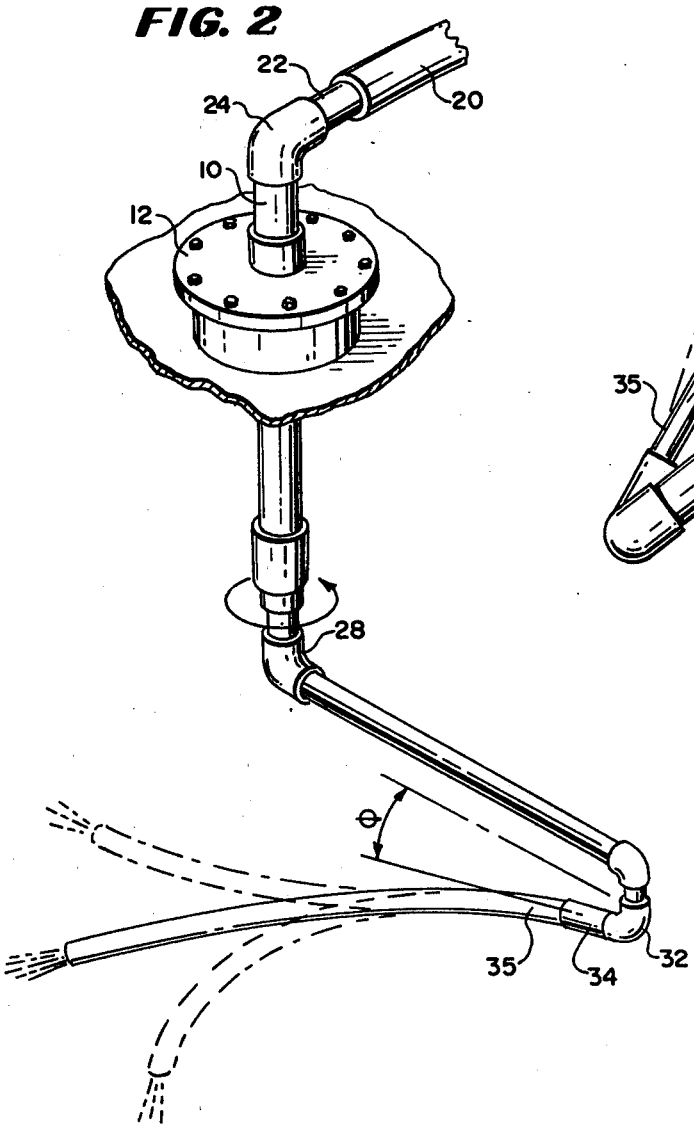
FIG. 2 is a perspective view of the installation shown in FIG. 1 with the hatch size is reduced for drawing purposes.

A preferred embodiment of the invention is illustrated in FIG. 1 in which a vertical conduit 10 is mounted to extend through a removable conventional hatch 12 for use and access on a cargo tank 14 consigned to transport digested sewage sludge which invariable has approximately a foot deep layer of sludge solids 17 settled on the bottom 16 of the tank by the end of a trip. These settled solids will not drain out through the tank drain 18 even when drainage forcing pumps are used.

Figure 3:
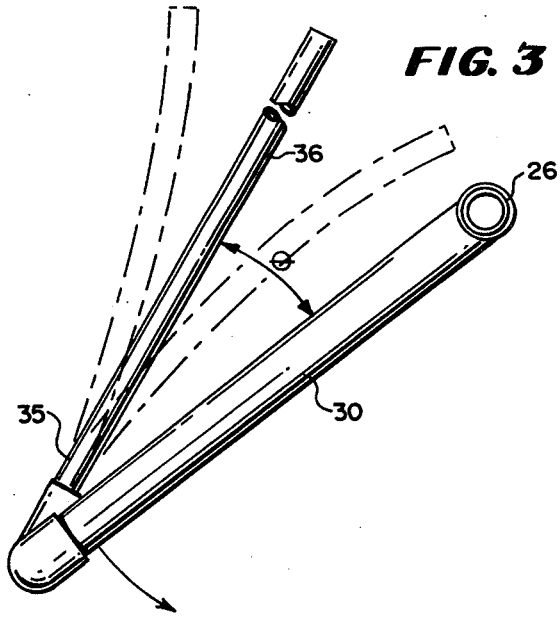
FIG. 3 is a plan view indicating an adjusted $\theta$ angle between the centerlines of the other rotatable pipe and the pipe whose discharge urges the rotation.

A high-pressure water supply hose 20 is attached to the conduit 10 by a quick disconnect coupling 22 carried on an elbow 24 at the upper end of the conduit 10. Preferably near the lower end of the conduit 10 a freely rotating swivel joint 26 is mounted whose lower end rotatably supports a right angle elbow 28. The elbow 28 carries a long nipple 30 having a downwardly oriented elbow at its remote end which carries a rotatable friction joint elbow 32 which carries a nipple 34 supporting pipe section 35 and a flexible hose 36 which in turn is so oriented and arranged as to provide in plan an angle $\theta$ (FIG. 3) between the conduit 30 and the moment arm 35 and hose 36. The reaction upon the moment arm at angle $\theta$ when ejecting water under pressure provides a moment of force rotating the hose 36 in the direction of the arrow 38. Adjustment of the angle $\theta$ determines in part the speed of rotation. Change of water pressure would be another factor.

Preferably, for purposes of disclosing an optimal working machine, the vertical conduit 10 preferably is a 2-inch pipe; the pipe 30 is a 1-inch pipe approximately 3 feet long and the hose 36 is 1 inch in diameter with the free end free to move in a random fashion.

Water supplied to the machine at approximately 100/gpm produces a high pressure jet emanating from the hydraulic hose and provides a jet reaction which causes the free end of the hose to whip down and sideways but with only a minor movement upwardly above level due to the hose, weight, and a set curl induced when it was coiled which if desired can be selectively varied, thereby directing wash water in a pie-shaped sector extending from the center line at upright 10 to a radius up to 50 feet.

The depth of the sector depends in most part on the height of the moment arm 30 which preferrably clears the sediment level in the tank. Only occasionally will the hose direct water above the level of the moment arm. The angular $\theta$ relation governs the speed of rotation by the water jet thrust.

The best results observed were observed when the $\theta$ angle was adjusted to provide reliable rotation at a slow speed of 10/R.P.M., the speed varying from instant to instant depending upon the whipping action of the hose, and therefore upon the composite hose action.

The following conditions lead to increased whipped action:

1. Increased water flow rate
2. Decreased internal water pressure
3. Decreased hose diameter
4. Decreased hose wall thickness
5. Decreased hose elasticity
6. Increased hose length
7. Increased moment arm length locates whipping effect closer to center of rotation
8. Inherent curl in hose due to its original coiling By way of example but not limitation: a successful configuration for the tank cleaning machine as shown in FIG. 1 was established from a series of field trials which were conducted on the basis of the idealized model given above.

Initial tests on ¾ inch and 1-inch diameter cloth-reinforced rubber hose showed that such hose tended to flatten to an elliptical cross section which restricted water flow and exaggerated the whipping action since the area moment of inertia was reduced to that water was emitted as a coarse spray rather than a coherent jet. Hose distortion was controlled by constricting the free end discharge opening which has the effect of increasing internal pressure. This modification improved hose action, but it was found that the water supply pressure has to be maintained within narrow limits in order to maintain the desired action.

More satisfactory whipping action was obtained using a 1½ inch diameter cloth-reinforced rubber hose constricted at its free end. The hose was responsive to a range of pressures, and it did not collapse or flutter. However, the hose weight, including the water in it, tended to an essentially limit whipping to horizontal motion, which is undesireable from the standpoint of good water distribution of great radii.

Based on the foregoing field trials, it was recognized that the ideal hose would be about 1-inch diameter and very resistant to collapse. Hydraulic hose which incorporates a layer of steel wire braiding meets these specifications. Since hydraulic hose is very stiff compared to cloth-reinforced hose, it must be substantially longer to achieve proper whipping action and its natural curve derived from being coiled when directed downwardly provided the best results.

Further testing demonstrated that a 6-foot length of 1-inch diameter hydraulic hose gave excellent water distribution at practical levels of water pressure and flow rate. No constriction of hose at its free end was required. The hose was responsive to a range of water pressures, and it was noted that bending of the hose was not pronounced, thus hose wearability is good and periods between servicing are quite extended.

Thus, in the present invention, water supplied at approximately 100/gpm produces a high pressure jet emanating from a nozzle on the free end of a conduit mechanism which bodily rotates an outwardly and downwardly inclined jet in a circle about the central axis and preferably with increasing water pressure that gradually raises the nozzle to increase the effective diameter of the wash, the jet reaction imparting the turning moment at a swivel joint with the speed of rotation governed by the speed and elevation as governed by the moment arm length and the angle of the inclined direction of the nozzle to a geometric radius and inclination from the horizontal as propelled preferably about 10/R.P.M. Residue wash-away from a 25 foot square area was accomplished in one-third the time required by conventional machines (10 minutes vs. 30 minutes) using about two thirds as much water, and, the device is readily adaptable to other sizes of areas.

The present invention not only handles residue with greater speed and efficiency but permits large tank-bottom uses and high consistences sludge averaging 8–10% without clogging effects.

From the foregoing, it can be observed that the new tank cleaning machine offers numerous advantages over conventional machines for washing away residue from tank bottoms. Its weight and natural curve as originally coiled directs it towards the bottom within an inherent radius of a few feet.

Desirable results include:

1. A violent water jet which is directed primarily towards the tank bottom to agitate and wash away residue. Wash water is used effectively.
2. Simplicity of construction can be produced and repaired inexpensively with common components. Maintenance is limited to occasionally greasing the swivel joint and replacing the rubber hose.
3. Fluids can readily be passed carrying suspended solids which would normally clog conventional machines incorporating a mechanism for nozzle rotation.
4. The machine can be easily adapted or adjusted for optimum operation under a variety of tank conditions.

What is claimed is:

1. A tank flat bottom cleaner comprising a vertical water supply conduit receivable in the tank including a lower portion rotatable about a vertical axis and extending to a point above liquefiable cargo on tank bottom, a moment arm conduit connected to and rotatably supported by said lower portion to extend laterally a predetermined distance for rotation around said vertical axis, a reversely directed flexible hose secured horizontally to the end of the moment arm to receive a horizontal stream of water under pressure therefrom and disposed to discharge at an angle to the axis of said moment arm to roatate it about said vertical conduit, said flexible hose being alternately curved by gravity to discharge water downwardly to flex upwardly and then jet upwardly to flex downwardly under gravity with water passing therethrough under pressure to whip the discharge stream upwardly and downwardly in a vertical quadrant.

2. The flexible hose defined in claim 1, said hose being approximately one inch in diameter when straight and reinforced by at least one layer of wire braiding normally flexing downwardly under its weight.

3. A flat bottom tank cleaner comprising a vertically disposed water supply conduit means supported on the tank and including a lower portion rotatable about a vertical axis with respect to the tank and extending to a point above liquefiable sediment resting on the flat bottom, a moment arm conduit connected to and rotatably supported by said lower portion to extend laterally a substantial distance for rotation around said vertical axis, a swivel joint defining a vertical axis carried by the outer end of the moment arm, flexible water discharge hydraulic hose means having a downward curvature under its own weight under resting conditions connected horizontally to said swivel joint and disposed in a vertical plane disposed at an acute angle $\theta$ to said moment arm for imparting a turning force to said moment arm and swivel through a horizontal area of 360° with the reactance of water discharged under pressure from the end of said discharge hose at said angle $\theta$.

4. The cleaner defined in claim 3 in which said dsicharge hose means is a flexible conduit free at its discharge end to whip vertically and be moved horizontally, and the angle $\theta$ determines the speed of rotation of the nozzle.

5. A tank bottom cleaner comprising a vertical conduit in a bottom cleaner for a tank having a top opening, a support resting on top of the opening, a vertical liquid conducting pipe section rotatably carried upon the support having an elbow at the bottom carrying a conduit having a horizontally disposed swivel joint means and an elbow connected to said swivel joint means with its downstream end disposed substantially horizontally, a flexible hydraulic hose connected to the last mentioned elbow extending horizontally with its free end normally inclined downwardly by gravity under resting conditions and terminating in a jet discharge opening, said hose disposed at a horizontal angle to said horizontal conduit and opening downwardly to provide a rotational force bodily rotating the pipe about the vertical axis of said elbow and the horizontal arm vertically about the axis of said last mentioned elbow, said assembly being removable through said top opening.

6. A flat bottom tank cleaner comprising a vertically disposed water supply conduit means extending into the tank a determined distance including a lower section rotatably about a vertical axis, a moment arm conduit extending laterally from and supported by said lower section for receiving therefrom water under pressure and being rotatable with said lower section, a swivel joint conduit means carried by the moment arm conduit including two sections rotationally adjustable with respect to each other, one of which is in communication with one of said swivel joint sections, and conduit means including a flexible hydraulic hose approximately one inch in diameter and approximately six feet long preferably reinforced with a layer of steel wire braiding and having a gravity induced primary curvature carried by and in horizontal communication with the other swivel joint section and with its free end directed under resting conditions substantially downwardly for movement in a vertical plane under the influence of gravity, said two sections being adjustable to establish a $\theta$ angle between the two conduits for rotating the moment arm and flexible hose 360° about said vertical axis.

* * * * *